US008672720B1

(12) United States Patent
Barbis

(10) Patent No.: US 8,672,720 B1
(45) **Date of Patent: *Mar. 18, 2014**

(54) LIFE VEST WITH RESCUE HANDLE

(75) Inventor: Richard A. Barbis, Eugene, OR (US)

(73) Assignee: Swimways Corporation, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/601,041

(22) Filed: Aug. 31, 2012

Related U.S. Application Data

(63) Continuation of application No. 12/584,964, filed on Sep. 14, 2009, now Pat. No. 8,262,426.

(51) Int. Cl.
*B63C 9/08* (2006.01)

(52) U.S. Cl.
USPC ..... 441/88

(58) Field of Classification Search
USPC ..... 441/88
See application file for complete search history.

(56) References Cited

U.S. PATENT DOCUMENTS

| | | | | |
|---|---|---|---|---|
| D26,956 | S | | 4/1897 | Samuel |
| 2,377,865 | A | | 6/1945 | Coombs |
| D149,579 | S | | 5/1948 | Messing |
| 2,935,751 | A | | 5/1960 | Emmick et al. |
| D211,217 | S | | 5/1968 | Bales |
| D234,793 | S | | 4/1975 | O'Link |
| D244,958 | S | | 7/1977 | Bleser |
| 4,035,856 | A | | 7/1977 | Oberg |
| D245,532 | S | * | 8/1977 | Taylor ..... D21/805 |
| D280,845 | S | | 10/1985 | Evert |
| D290,922 | S | | 7/1987 | Herrera |
| D292,015 | S | | 9/1987 | McWaters |
| 4,863,409 | A | | 9/1989 | Johnson et al. |
| 4,964,827 | A | | 10/1990 | Rudy |
| 5,015,208 | A | | 5/1991 | Fox et al. |
| 5,055,075 | A | | 10/1991 | Waller, Jr. |
| D357,297 | S | | 4/1995 | Newton |
| 5,632,235 | A | | 5/1997 | Larsen et al. |
| 5,671,480 | A | | 9/1997 | Krout et al. |
| 5,766,114 | A | | 6/1998 | Campbell |
| 5,855,497 | A | | 1/1999 | French |
| D422,665 | S | | 4/2000 | Steger |
| D428,956 | S | | 8/2000 | Harwell, IV |
| D433,090 | S | | 10/2000 | Harwell, IV et al. |
| 6,309,270 | B1 | | 10/2001 | Harwell, IV et al. |
| 6,375,530 | B1 | | 4/2002 | Earl |
| D461,871 | S | | 8/2002 | Flowers |
| 6,524,145 | B1 | | 2/2003 | Arzate |

(Continued)

OTHER PUBLICATIONS

Co-pending U.S. Appl. No. 29/373,200, entitled "Dolphin/Shark Hook Fin on Swim Vest," filed Mar. 15, 2011, 2 pages.

(Continued)

*Primary Examiner* — Lars A Olson
*Assistant Examiner* — Anthony Wiest

(57) ABSTRACT

A life vest with a rescue handle located on the back side thereof. The rescue handle has a flange located at the lower end thereof, the flange being attached to the back side of the life vest with the rescue handle extending substantially vertically upwards. The rescue handle is attached to the back side of the life vest in a manner adapted to support the weight of a user. The rescue handle has a non-loop shape that eliminates the potential for entanglement with objects in the water.

21 Claims, 3 Drawing Sheets

(56) References Cited

U.S. PATENT DOCUMENTS

| | | | | |
|---|---|---|---|---|
| 6,582,266 | B1 * | 6/2003 | Steger et al. | 441/106 |
| 6,582,267 | B1 | 6/2003 | Steger | |
| 6,659,824 | B1 | 12/2003 | McCormick | |
| D494,652 | S | 8/2004 | Otto | |
| D497,965 | S | 11/2004 | Barbis | |
| D507,084 | S | 7/2005 | Sabeh-Azar | |
| D510,160 | S | 9/2005 | Rominger | |
| 7,331,836 | B1 | 2/2008 | Harris | |
| D576,243 | S * | 9/2008 | Moseley | D21/803 |
| 7,559,817 | B2 | 7/2009 | Von Zell | |
| D604,788 | S | 11/2009 | Barbis et al. | |
| D606,151 | S | 12/2009 | Barbis et al. | |
| D606,152 | S | 12/2009 | Barbis et al. | |
| D622,800 | S | 8/2010 | Barbis | |
| D622,801 | S | 8/2010 | Barbis | |
| D638,083 | S | 5/2011 | Barbis | |
| D638,084 | S | 5/2011 | Barbis | |
| D638,085 | S | 5/2011 | Barbis et al. | |
| D650,033 | S | 12/2011 | Barbis | |
| D663,003 | S | 7/2012 | Barbis | |
| D667,911 | S | 9/2012 | Barbis | |
| 8,262,426 | B1 | 9/2012 | Barbis | |
| 2008/0258527 | A1 | 10/2008 | Gower et al. | |
| 2013/0005203 | A1 | 1/2013 | Barbis | |

OTHER PUBLICATIONS

Co-pending U.S. Appl. No. 29/432,288, entitled "Life Jacket with Fin and Headrest," filed Sep. 14, 2012, 6 pages.

* cited by examiner

LIFE VEST WITH RESCUE HANDLE

CROSS-REFERENCE TO RELATED APPLICATIONS

This application is a continuation of U.S. patent application Ser. No. 12/584,964, filed Sep. 14, 2009, and entitled "Life Vest with Rescue Handle," the disclosure of which is incorporated herein by reference in its entirety.

BACKGROUND OF THE INVENTION

The present invention relates to a life vest having a rescue handle that can be grabbed by a rescuer to assist in lifting the wearer from a body of water.

Life vests are a type of flotation device intended to keep the wearer on the surface of a body of water, either while swimming or after accidentally falling into the water from a water craft. Such vests are more often used by younger swimmers or boaters, and are often required by law for such persons. In the event the wearer requires rescuing by being pulled from the water it is often difficult to find a place to be able to grab and lift the person or vest, particularly if the wearer is floating on his/her stomach.

Life vests for dogs are commercially available which include a loop-type handle on the back of the vest to allow a dog wearing the vest to be lifted from the water. However, such loops are prohibited on life vests to be used by humans because of the danger of the loop becoming snagged on fallen trees, etc., located in the water.

SUMMARY OF THE INVENTION

It is an object of the present invention to provide a life vest with a rescue handle.

The rescue handle has a flange located at the lower end thereof, the flange being attached to the back side of a life vest in a manner adapted to support the weight of a wearer. The rescue handle has a shape that eliminates the potential for entanglement with objects in the water.

DESCRIPTION OF PREFERRED EMBODIMENTS

Figure 1:
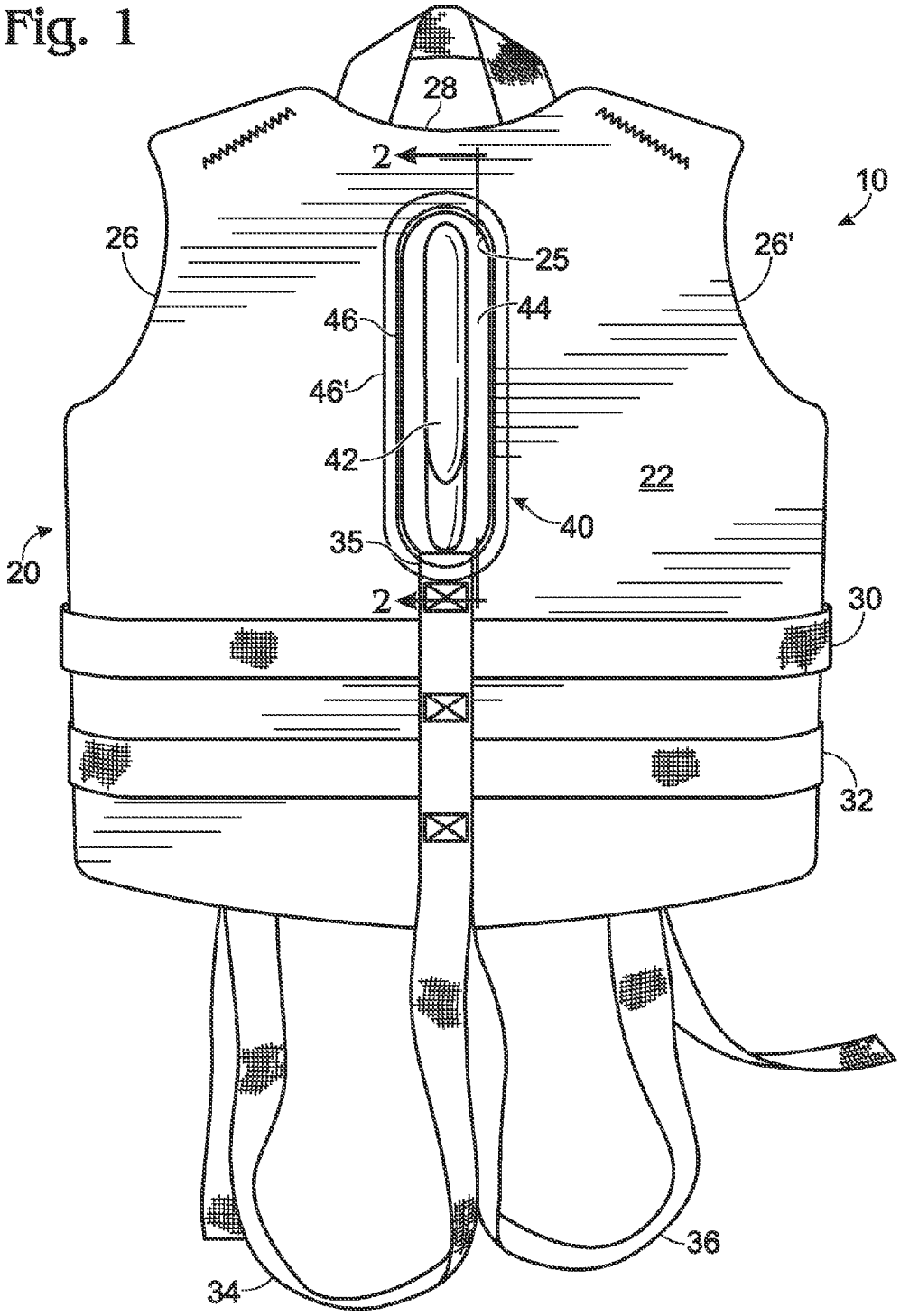
FIG. 1 is an elevation view of the back side of a life vest with rescue handle of the present invention where the handle is in the shape of a fish fin.

The life vest with rescue handle 10 includes a life vest portion 20 and a handle subassembly 40 attached to the back side 22 thereof, as described in more detail below.

The life vest portion 20 includes a back side 22, left and right arm openings 26 and 26', a collar portion 28, upper and lower horizontal waist straps 30 and 32 (only the rear portions being shown), and left and right leg straps 34 and 36 (only the rear portions being shown). The front ends of upper and lower horizontal waist straps 30 and 32 (not shown) and left and right leg straps 34 and 36 (not shown), have attachment means such as buckles, as well known in the life vest art. The front left and front right sides of the vest portion 20 (not shown) can be removably attached together, such as by a zipper, as well known in the life vest art.

The handle subassembly 40 includes a rescue handle 42 adapted to be grasped by a rescuer. In the drawings handle 42 is shaped like a fish fin, such as a shark fin, for life vests to be used by children in swimming situations. However, rescue handle 42 can have other non-loop shapes that are not subject to entanglement with objects in the water, such as the rectangular shape shown in FIGS. 5 and 6.

Figure 4:
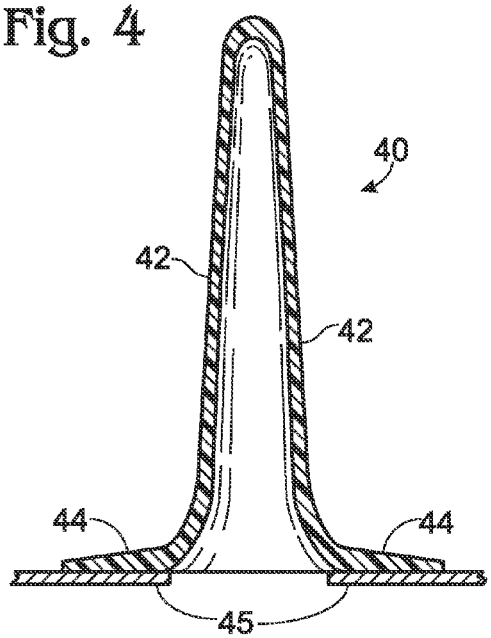
FIG. 4 is a cross-section view of the rescue handle taken along line 4-4 of FIG. 3.

Rescue handle 42 extends upwardly from a base or flange 44. The major planes of rescue handle 42 and flange 44 are substantially perpendicular to each other. Rescue handle 42 and flange 44 are preferably molded as a single piece by rotational molding of a suitable polymeric material, such as polyvinyl chloride. However, rescue handle 42 could be molded separately and welded to a flange 44. Preferably rescue handle 42 is hollow (as best seen in FIG. 4), and formed of a flexible polymeric material that is able to bend when the wearer sits in a chair. Flange 44 can contain reinforcing material such as fibers.

A reinforcing membrane 45 is preferably attached to the bottom of flange 44 to provide added strength. Reinforcing membrane can be formed of any suitable material, such as polyvinyl chloride sheet impregnated with reinforcing material or nylon webbing, and can be attached to flange 44 by any suitable means such as sewing and/or heat welding.

Figure 2:
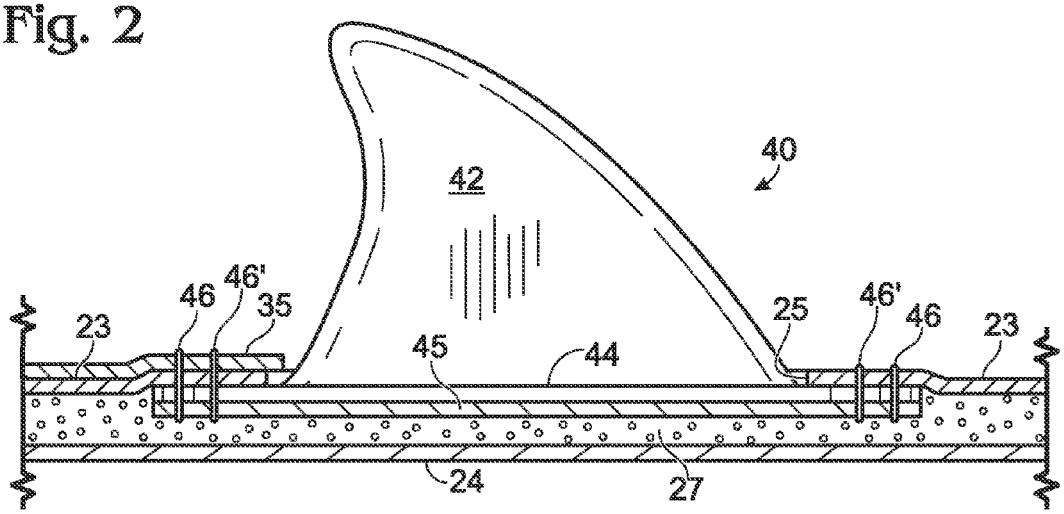
FIG. 2 is a partial side elevation view the life vest with rescue handle taken along line 2-2 of FIG. 1.
Figure 3:
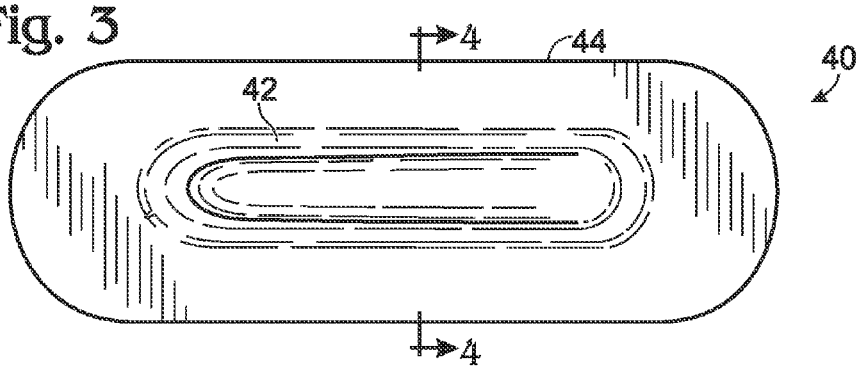
FIG. 3 is a top plan view of the rescue handle prior to attachment to a life vest.

Life vest portion 20 is formed of two layers of fabric, such as ballistic nylon, neoprene, or other material, and includes an outer layer 23 and an inner layer 24, as best seen in FIG. 2. A flotation panel 27 is positioned between outer and inner layers 23, 24, in a manner well known in the art. An elongated opening 25 is located in the upper mid-portion of that portion of outer layer 23 forming the back 22, with rescue handle 42 extending upwardly there through. A substantial portion of the upper surface of flange 44 abuts that portion of the lower surface of the outer layer 23 located adjacent opening 25. Flange 44 and attached reinforcing membrane 45 are attached to that area of the lower surface of outer layer 23 located adjacent opening 25 of outer layer 23 by any suitable attachment means, such as stitches 46, 46', prior to outer and inner layers 23 and 24 being joined together to form life vest portion 20. The stitches 46, 46' may pass through vertical strap portion 35 for added strength. The area and thickness of flange 44, and the stitching and stitching pattern, are selected to provide a strength of attachment of rescue handle to back 22 of life vest portion 20 that will support lifting a wearer which, in the case of a youngster would be up to about 150 pounds, and in the case of an adult up to about 300 pounds.

Reinforcing membrane 45 can be substantially the same size as flange 44, or it can extend beyond flange 44 up to an area including the entire back side 22 of vest 20 in order to increase the lifting capacity of handle subassembly 40.

Figure 5:
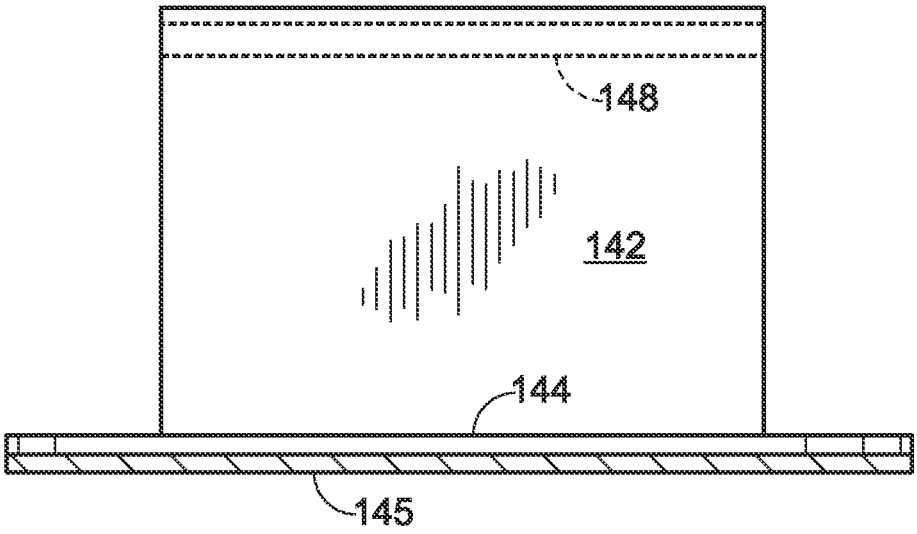
FIG. 5 is a partial side elevation view of the life vest with rescue handle where the handle has a rectangular shape and includes a lift assist member.
Figure 6:
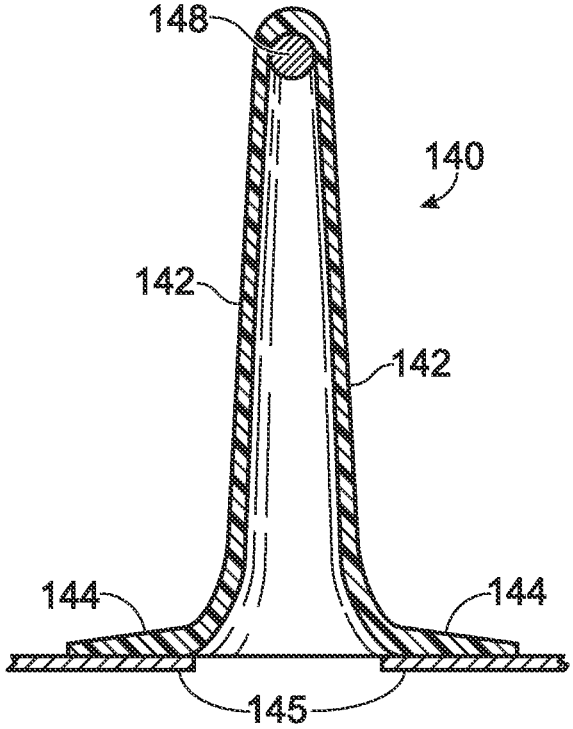
FIG. 6 is a cross-section view of the rescue handle of FIG. 5 taken along line 5-5.

FIGS. 5 and 6 show a handle subassembly 140 which includes a rescue handle 142, flange 144, reinforcing membrane 145, and a lift assist member 148. Rescue handle 142 has a rectangular shape.

Rescue handle 142 extends upwardly from a base or flange 144. The major planes of rescue handle 42 and flange 44 are substantially perpendicular to each other. Rescue handle 142 and flange 144 are preferably molded as a single piece by rotational molding of a suitable polymeric material, such as polyvinyl chloride. However, rescue handle 142 could be molded separately and welded to a flange 144. Preferably rescue handle 142 is hollow (as best seen in FIG. 6), and formed of a flexible polymeric material that is able to bend when the wearer sits in a chair.

A reinforcing membrane 145 is attached to the bottom of flange 144 to provide added strength. Reinforcing membrane can be formed of any suitable material, such as polyvinyl chloride sheet impregnated with reinforcing material or nylon webbing, and can be attached to flange 44 by any suitable means such as sewing and/or heat welding.

A lift assist member 148 is positioned within and attached to the upper end of hollow rescue handle 142, and preferably is a cylindrical member formed of a polymeric or elastomeric foam material. Preferably lift assist member 148 extends substantially from the front to the rear of hollow rescue handle 142. A similar lift assist member could be located within rescue handle 42.

The term "life vest" as used herein is intended to include any type of flotation assistance device to which the rescue handle described herein can be attached, such as "swim assist vests" and solid foam life jackets.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An apparatus, comprising:

a swim assist vest having a back portion; and a handle subassembly including a rescue handle and a flange, the rescue handle having a surface substantially oriented along a first plane and the flange having a surface substantially oriented along a second plane, the second plane being substantially perpendicular to the first plane, the rescue handle extending substantially perpendicular relative to the back portion in a fixed position, the flange being coupled to the back portion of the swim assist vest such that a weight of a wearer is supported when the rescue handle is pulled, the back portion of the swim assist vest includes at least a portion formed of an inner layer and an outer layer of fabric and a flotation panel located between the outer layer of fabric and the inner layer of fabric, the outer layer of fabric having an opening, a portion of the rescue handle is received through the opening such that at least a portion of the flange is disposed between a portion of the outer layer of fabric and a portion of the inner layer.

2. The apparatus of claim 1, wherein the rescue handle is in the shape of a shark fin.

3. The apparatus of claim 1, wherein the rescue handle and the back portion of the swim assist vest collectively define a hollow region of the rescue handle, the apparatus further comprising:

a lift assist member disposed within the hollow region of the rescue handle.

4. The apparatus of claim 1, further comprising:

a membrane disposed at least partially between the flange and the flotation panel.

5. The apparatus of claim 1, wherein the rescue handle and the back portion of the swim assist vest collectively define a hollow region of the rescue handle.

6. The apparatus of claim 1, wherein the flange is attached to the outer layer of fabric by stitching.

7. An apparatus, comprising:

a swim assist vest having a back portion; and a handle subassembly including a rescue handle and a flange, the handle subassembly including a first material and the back portion of the swim assist vest including a second material different than the first material, the handle subassembly coupled to the back portion of the swim assist vest, the rescue handle having a surface substantially extending within a first plane, the flange being formed monolithically with the rescue handle and having a surface substantially extending within a second plane, the second plane being substantially perpendicular to the first plane, the flange being disposed within an opening defined in the back portion of the swim assist vest such that the rescue handle is oriented substantially perpendicular to the back portion of the swim assist vest when the apparatus is worn by a wearer.

8. The apparatus of claim 7, wherein the rescue handle and the back portion of the swim assist vest collectively define a hollow region of the rescue handle, the apparatus further comprising:

a lift assist member disposed within the hollow region of the rescue handle.

9. The apparatus of claim 8, wherein the lift assist member is cylindrical in shape and extends substantially from a front to a rear of the rescue handle.

10. The apparatus of claim 7, wherein the back portion of the swim assist vest includes at least a portion formed of an inner layer and an outer layer of fabric and a flotation panel located between the outer layer of fabric and the inner layer of fabric, the outer layer of fabric having an opening, a portion of the rescue handle received through the opening such that at least a portion of the flange is disposed between a portion of the outer layer of fabric and a portion of the inner layer.

11. The apparatus of claim 10, wherein the flange is attached to the outer layer of fabric by stitching.

12. The apparatus of claim 7, wherein at least a portion of the back portion of the swim assist vest includes an inner layer and an outer layer of fabric and a flotation panel disposed between the inner layer and the outer layer of fabric, the outer layer of fabric having an opening, a portion of the rescue handle received through the opening such that at least a portion of the flange is disposed between the outer layer of fabric and the inner layer of fabric, the flange being attached to the outer layer of fabric, the apparatus further comprising:

a membrane disposed at least partially between the flange and the flotation panel, the membrane configured to increase a lifting capacity of the handle subassembly.

13. The apparatus of claim 7, wherein the rescue handle and the back portion of the swim assist vest collectively define a hollow region of the rescue handle.

14. An apparatus, comprising:

a swim assist vest; and a handle subassembly including a rescue handle and a flange monolithically formed with the rescue handle, the handle subassembly including a first material and the swim assist vest including an outer layer including a second material different than the first material, the handle subassembly coupled to the outer layer of the swim assist vest, the rescue handle having a length and a width along a first plane greater than a depth perpendicular to the first plane, the flange having a length and a width along a second plane greater than a depth perpendicular to the second plane, the first plane being substantially perpendicular to the second plane, at least a portion of the flange being disposed within an opening defined in a portion of the swim assist vest such that the rescue handle is substantially perpendicular to the portion of the swim assist vest.

15. The apparatus of claim 14, wherein the swim assist vest includes an inner layer, an outer layer and a flotation panel disposed between the outer layer and the inner layer, the outer layer defining the opening, the at least a portion of the flange being disposed within the opening such that at least a portion of the flange is disposed between a portion of the outer layer and a portion of the inner layer.

16. The apparatus of claim 14, wherein the swim assist vest includes an inner layer, an outer layer and a flotation panel disposed between the outer layer and the inner layer, the outer layer defining the opening, the at least a portion of the flange being disposed within the opening such that at least a portion of the flange is disposed between a portion of the outer layer and a portion of the inner layer, the apparatus further comprising:

a membrane disposed at least partially between the flange and the flotation panel.

17. The apparatus of claim 14, wherein the rescue handle and the portion of the swim assist vest collectively define a hollow region.

18. An apparatus, comprising:

a swim assist vest having a back portion; and a handle subassembly coupled to the swim assist vest and including a rescue handle and a flange, the rescue handle extending in a first direction more than in a second direction and a third direction each perpendicular to the first direction, the flange extending in the second direction more than in the first direction and the third direction, the rescue handle extending substantially perpendicular relative to the back portion in a fixed position relative to the back portion and being formed with a flexible material such that at least a portion of the rescue handle is bendable, the rescue handle and the back portion of the swim assist member collectively defining a hollow region.

19. The apparatus of claim 18, wherein the rescue handle has a length and a width along a first plane greater than a depth perpendicular to the first plane, the flange having a length and a width along a second plane greater than a depth perpendicular to the second plane, the second plane being substantially perpendicular to the first plane.

20. The apparatus of claim 18, wherein the back portion of the swim assist vest includes an inner layer, an outer layer and a flotation panel disposed between the outer layer and the inner layer, the outer layer having an opening, a portion of the rescue handle being disposed within the opening such that at least a portion of the flange is disposed between a portion of the outer layer and a portion of the inner layer.

21. The apparatus of claim 18, wherein the back portion of the swim assist vest includes an inner layer, an outer layer and a flotation panel disposed between the outer layer and the inner layer, the outer layer having an opening, a portion of the rescue handle being disposed within the opening such that at least a portion of the flange is disposed between a portion of the outer layer and a portion of the inner layer, the apparatus further comprising:

a membrane disposed at least partially between the flange and the flotation panel.

* * * * *